US008418633B1

(12) United States Patent
Lee

(10) Patent No.: US 8,418,633 B1
(45) Date of Patent: Apr. 16, 2013

(54) SYMMETRICAL TABLE LEG FASTENER TABLE

(75) Inventor: Clifton Shao-ming Lee, Hillsborough, CA (US)

(73) Assignee: Numark Industries Company Limited, Hung Hom (CN)

( * ) Notice: Subject to any disclaimer, the term of this patent is extended or adjusted under 35 U.S.C. 154(b) by 0 days.

(21) Appl. No.: 13/200,770

(22) Filed: Sep. 30, 2011

(51) Int. Cl.
*A47B 13/00* (2006.01)

(52) U.S. Cl.
USPC ..... 108/157.1; 108/157.15; 108/27

(58) Field of Classification Search ..... 108/27, 108/157.1, 157.18, 157.15, 157.16, 159, 108/158.13, 158.12, 153.1, 156, 154, 155; 248/188, 188.1; 40/782
See application file for complete search history.

(56) References Cited

U.S. PATENT DOCUMENTS 597,050 A * 1/1898 Dane ..... 108/157.1
1,697,094 A * 1/1929 Turk ..... 108/157.15
3,643,608 A * 2/1972 DeCesaris ..... 108/153.1
4,092,042 A * 5/1978 Cusenbary ..... 108/157.1
4,324,433 A * 4/1982 Saiger ..... 108/155
4,805,541 A * 2/1989 Drane et al. ..... 108/27
4,905,612 A * 3/1990 Apissomian ..... 108/157.15
4,941,413 A * 7/1990 Vanderminden ..... 108/157.15
5,404,828 A * 4/1995 Tesney ..... 108/157.15
5,471,936 A * 12/1995 Kemnitz ..... 108/27
6,006,679 A * 12/1999 Lin ..... 108/157.15
6,553,921 B2 * 4/2003 Liu ..... 108/157.15
6,877,443 B2 * 4/2005 Rivera et al. ..... 108/157.15

* cited by examiner

*Primary Examiner* — Jose V Chen
(74) *Attorney, Agent, or Firm* — Daniel Hopen

(57) ABSTRACT

Some embodiments of the present disclosure provide a method and apparatus for a symmetrical table leg fastener table. The table affords simplicity without having to match sets of legs to particular corners of the table. The table comprises a table top frame having a rim around an interior of the table top frame. Four corner assemblies are attached to each corner of the rim of the table top frame. The corner assemblies are set to bisect each corner. Each corner assembly includes a first metal clip attached to a rim of a first side of the table frame, a second metal clip attached to a rim of a second side of the table frame, and a U-shaped metal clip coupled to the first metal clip and the second metal clip. Four table legs are each attached to a corner assembly.

13 Claims, 5 Drawing Sheets

SYMMETRICAL TABLE LEG FASTENER TABLE

BACKGROUND

1. Technical Field

This disclosure generally relates to securing table legs, and more particularly to a robust fastener for securing a table leg against each corner at the table underside rim.

2. Related Art

Conventional outdoor furniture of the type intended for use on decks and patios are very popular. Manufacturers of outdoor patio furniture are constantly called upon to offer new innovative designs that provide practical, comfortable products to the consumer. Manufacturers on one hand are interested in offering innovative and fresh designs, but are also interested in reducing manufacturing cost by simplifying complexity and reducing the time for assembling the outdoor patio furniture.

As the outdoor patio furniture industry has developed, a popular item is the patio table. In the past, two different types of legs are provided for a typical rectangular table. Two different types of legs not only adds complexity to manufacturing by requiring extra tooling of machinery but creates confusion for the packager and end user, particularly when the user is tasked to assembly the patio table. What is needed is a table design that is simpler to manufacture, less confusing to package and assemble while still maintaining structural robustness.

SUMMARY OF INVENTION

A method and apparatus for a novel symmetrical table leg fastener table are disclosed which overcome shortcomings of prior art tables requiring two set of legs. Other benefits include simplifying the packaging process and assembly of the table. Accordingly, the novel symmetrical table leg fastener comprises a table top frame having a rim around an interior of the table top frame, four corner assemblies attached to each corner of the rim of the table top frame, the corner assembly includes, a first metal clip attached to a rim of a first side of the table frame proximate to a corner, a second metal attached to a rim of a second side of the table frame proximate to the corner, and a U-shaped metal clip coupled to the first metal clip and the second metal clip, four table legs each attached to a corner assembly, each table leg bisects a corner assembly and is attached to the U-shaped metal clip, and a table top surface proximate to a top side of the table top frame.

In accordance to another embodiment of the present invention, the table top frame is rectangular.

In accordance to another embodiment of the present invention, each table leg includes a threaded hole configured to receive a threaded leg bolt that secures the table leg to the U-shaped metal clip.

In accordance to another aspect of the present invention, the first metal clip includes a threaded hole for receiving a first threaded clip bolt securing a first end of the U-shaped metal clip to the first metal clip and the second metal clip includes a threaded hole for receiving a second threaded clip bolt securing a second end of the U-shaped metal clip to the second metal clip.

DETAILED DESCRIPTION

Figure 1:
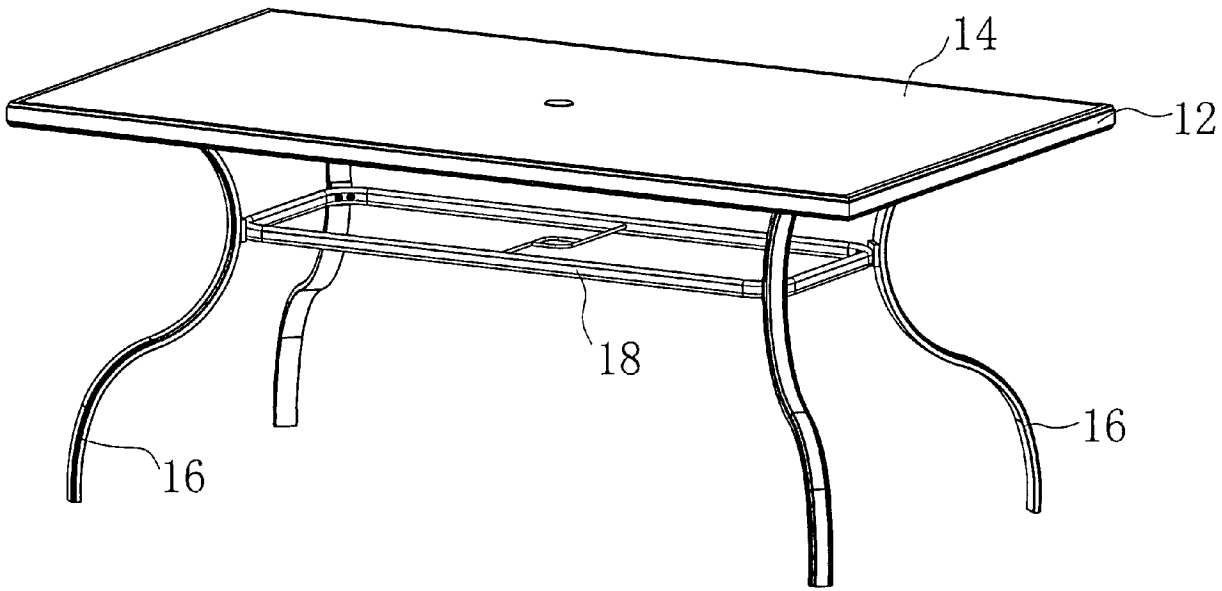
FIG. 1 illustrates a symmetrical table leg fastener table in accordance with an embodiment of the present invention.

FIG. 1 illustrates a symmetrical table leg fastener table 10 in accordance with an embodiment of the present invention. The table 10 includes a table top frame 12, a table top insert 14, a set of table legs 16, and a support ring 18. The set of table legs 16 for the table 10 are symmetrical with each other. All the legs are interchangeable with any other leg and can be attached to any corner of the table 10. In the past, two sets of legs are used for attachment to the table.

Figure 2:
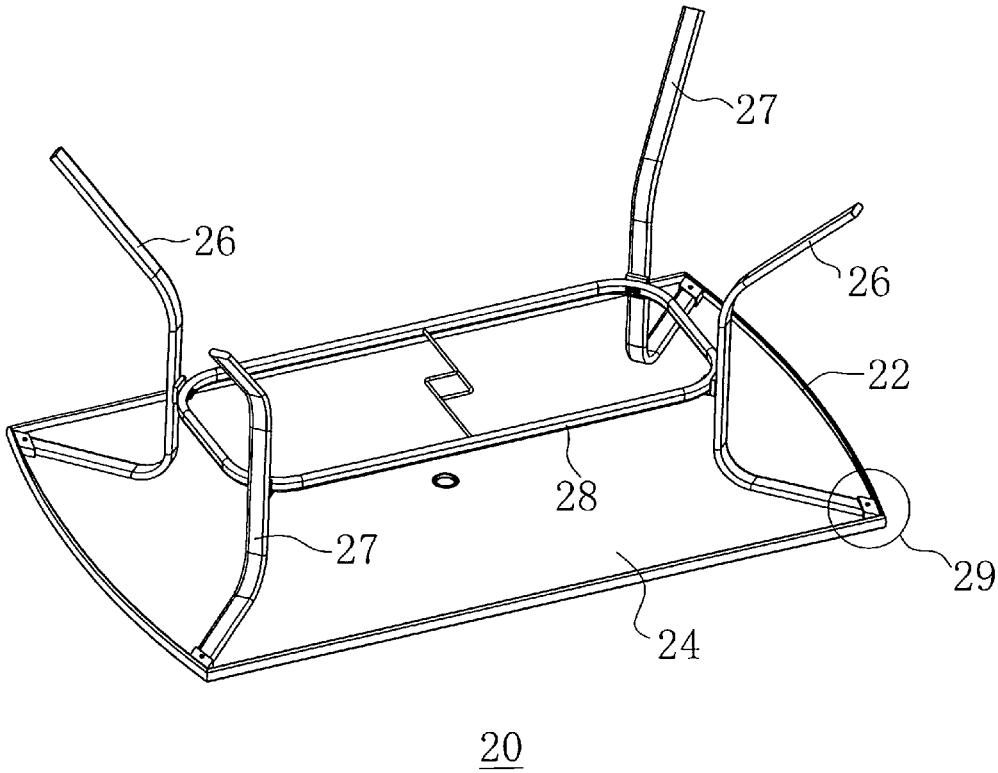
FIG. 2 (PRIOR ART)
FIG. 2 illustrates an underside of a prior art table having two set of different legs.
Figure 2:
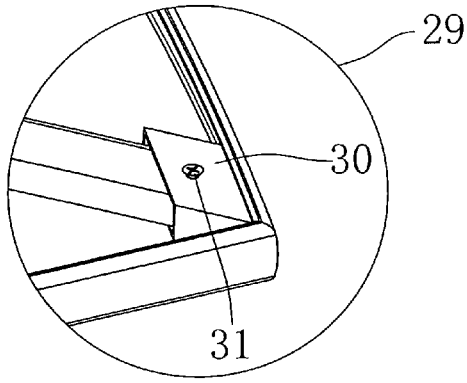
FIG. 2 (PRIOR ART)

FIG. 2 illustrates an underside view of a prior art table 20. The prior art table 20 includes a table top frame 22, a table top insert 24, a first set of legs 26, a second set of legs 27, and a support ring 28. It is appreciated that the legs 26 and legs 27 are different and cannot be interchangeably used for attachment to table 20. Referring now to corner 29, corner 29 is also enlarged to better illustrate the detail of how a leg is attached to the corner of the table 10. Each leg is attached to the short side of the rectangular table fitting into a slot 30. Two sets of slightly different legs must be used for attachment to the table 20. The requirement that two sets of legs be used complicates manufacturing and often causes confusion during packing of the table 20. Moreover, there is added confusion to the customers when they attempt to assemble the table.

Figure 3:
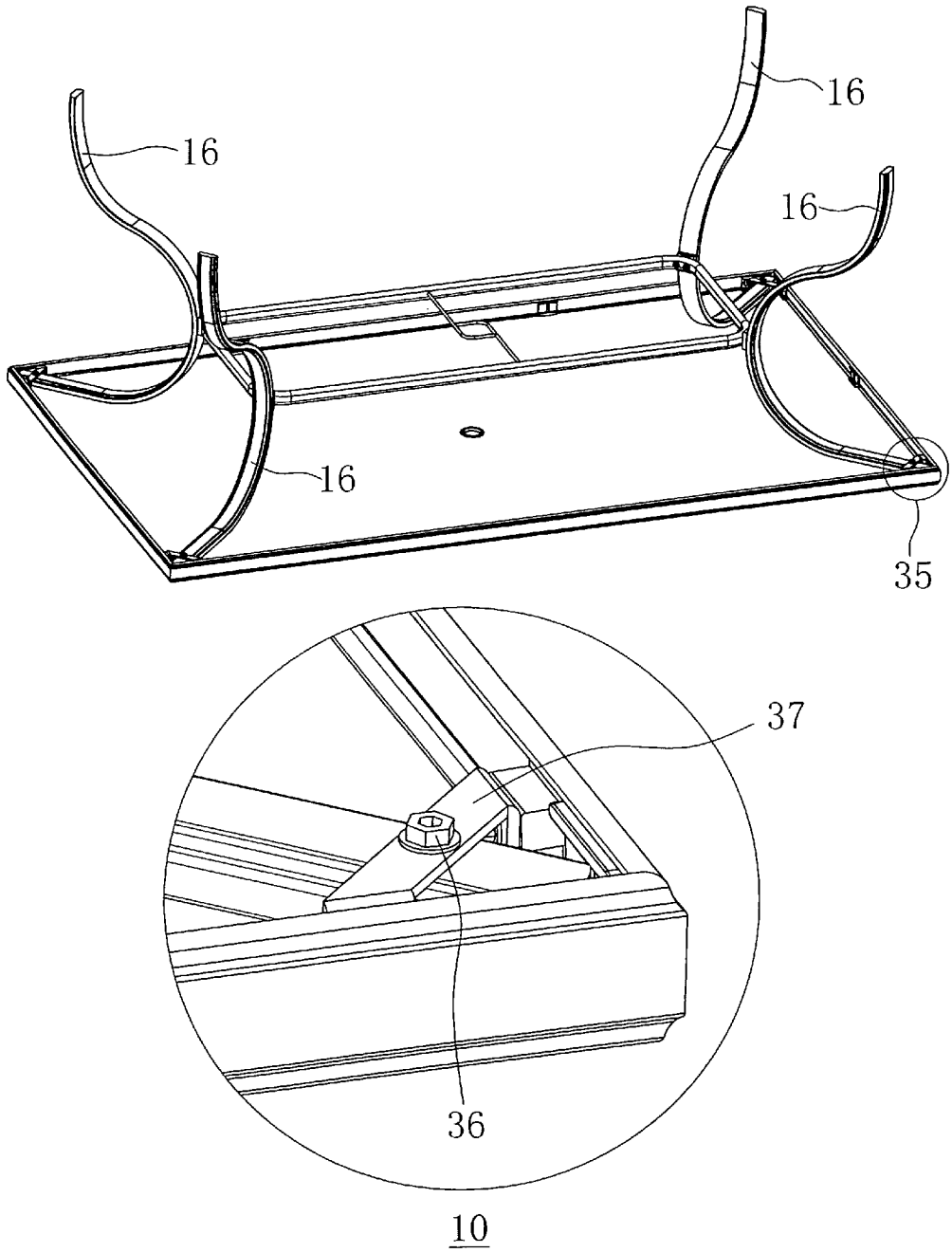
FIG. 3 illustrates an underside of the symmetrical table leg fastener table in accordance with an embodiment of the present invention.

FIG. 3 illustrates the underside of a symmetrical table leg fastener table 10 in accordance to an embodiment of the present invention. Legs 16 are identical and symmetrical with each other. Accordingly, each leg can be interchanged with another leg and still be properly assembled. Referring to corner assembly 35, corner assembly 35 is also enlarged to better illustrate the details of the corner assembly. It is appreciated that the corner assembly 35 bisects the corner of the table 10. When the legs 16 are attached to the table, each leg 16 bisects each corner of the table 10. A screw, bolt 36 is used to attach an end of the leg 16 to a U-shaped metal bracket 37 of the corner assembly 35.

Figure 4:
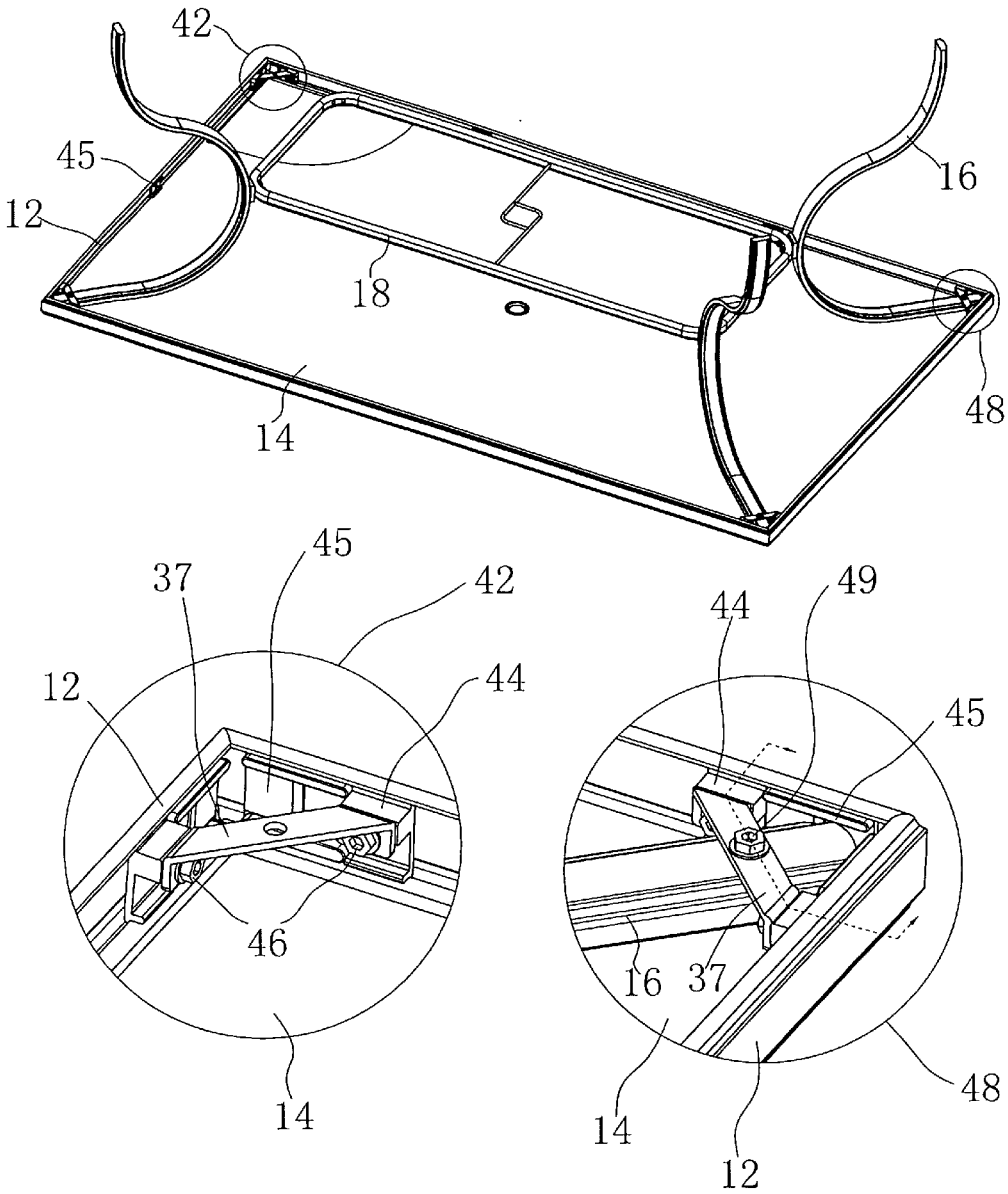
FIG. 4 illustrates corner assemblies of the symmetrical table leg fastener table in accordance with an embodiment of the present invention.

FIG. 4 illustrates an underside of the symmetrical table leg fastener table 10. Referring to symmetrical corner assembly 42, the corner assembly 42 is also enlarged to better illustrate in more detail the symmetrical corner assembly. The interior side of the table top frame 12 is slightly U-shaped comprising a bottom rim and a top lip (see also FIG. 5). A table top insert 14 is placed onto the table top frame 12 and rests on the top lip of the table top frame. Two metal clips 44 are attached between the table top insert 14 and the bottom rim of the table top frame 12. A first metal clip 44 is attached to a first side of the table top frame 12 proximate to the corner and a second metal clip 44 is attached to a second side of the table top frame 12 proximate to the corner. Plastic clips 45 are inserted between the table top insert 14 and the bottom rim of the table top frame 12 to further support the table top insert 14. The table top insert 14 is made of glass. The plastic clips 45 are inserted along the length of the table top frame and proximate the corner assemblies to provide adequate support for the table top glass insert. A. U-shaped metal bracket or clip 37 is attached diagonally between the two metal clips 44. Two screws, bolts 46 secure the U-shaped metal bracket or clip 37 to the two metal clips 44. Referring to another symmetrical corner assembly 48, the corner assembly is also enlarged to better illustrate in more detail the symmetrical corner assembly. In this view, leg 16 is shown attached to the symmetrical corner assembly. A screw, bolt 49 is used to secure the leg 16 to the U-shaped metal bracket.

Figure 5:
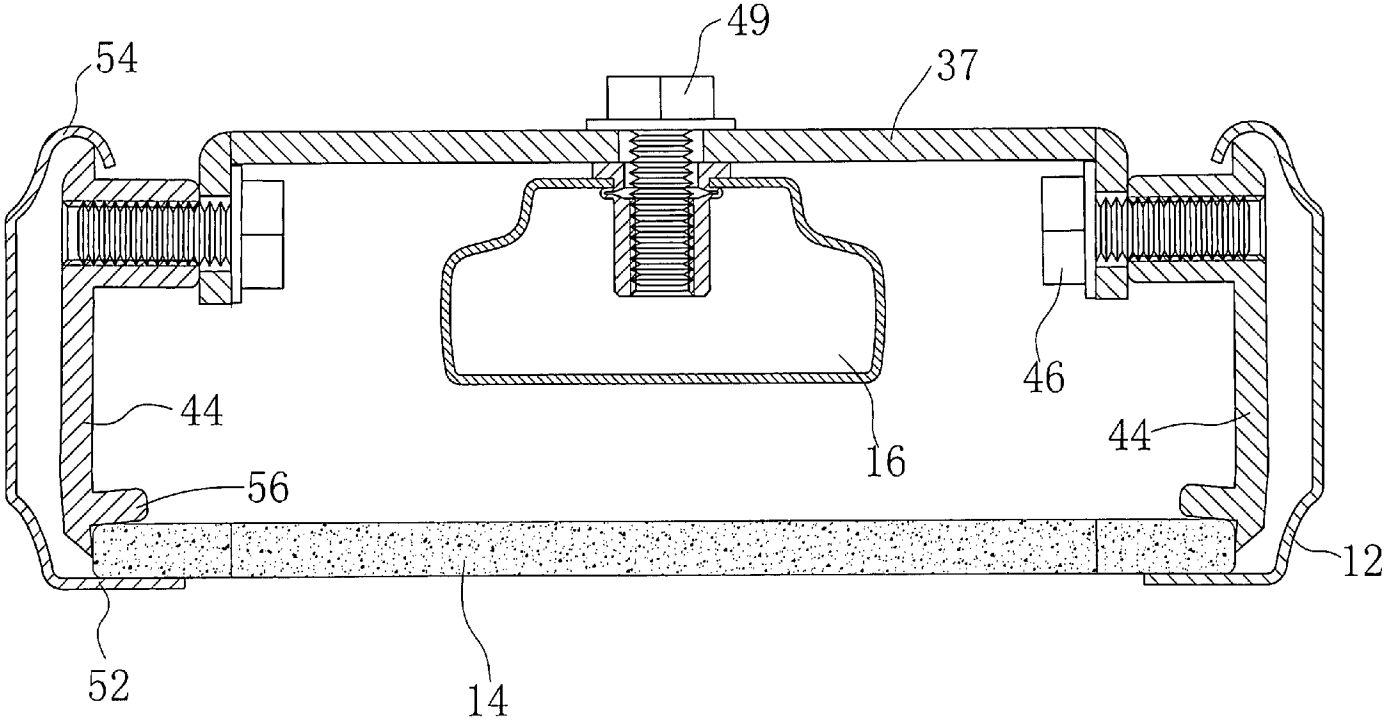
FIG. 5 illustrates an exemplary cut-out view of the corner assembly taken along dashed line A-A of FIG. 4.

FIG. 5 illustrates a cross-section of the corner assembly 48 of FIG. 4 taken along dashed line A-A. The table top frame 12 has a top lip 52 and a bottom rim 54. The metal clips 44 have a top shoulder 56. When the table is upright, the table top insert 14 rests against the top shoulder 56 of the metal clips 44. The rim 54 of the table top frame 12 supports the metal clips 44. The lip 52 of the table top frame 12 holds the table top insert 14 against the top shoulder 56 of the metal clips 44. The metal clips 44 include screw threads that enable the bolts 46 to screw into and secure the U-shaped metal clip 37 against the metal clips 44. Similarly, an end of the leg 16 includes screw threads that enable bolt 49 to screw into and secure the leg 16 against the U-shaped metal clip.

The present novel symmetrical table leg fastener table is susceptible to minor variations and modifications that may be introduced without departing from the inventive concept. For example, instead of a rim around the interior perimeter of the table top frame 12, multiple tangs strategically protruding from or attached to the table top frame can be used. More or less screws or other fastener devices can be used for the corner assemblies 42, 48.

It is further appreciated that designation of furniture as fitting into categories such as chairs, lounges, and other separate and distinct varieties may be inadequate. For example, patio furniture as opposed to furniture designs may show no clear delineation separating the two categories. Accordingly, a patio table design may be used as a table for indoor use.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Moreover, the above disclosure is not intended to limit the present invention. The scope of the present invention is defined by the claims.

I claim:

1. A table comprising:

a table top frame having a rim around an interior of the table top frame;

four corner assemblies attached to each corner of the rim of the table top frame, the corner assembly includes:

a first metal clip slideably attached to a first channel within the rim of a first side of the table frame proximate to a corner;

a second metal clip slideably attached to a second channel within the rim of a second side of the table frame proximate to the corner; and a U-shaped metal clip bolted to the first metal clip and the second metal clip;

four table legs each attached to a corner assembly, each table leg bisects a corner assembly and is bolted to the U-shaped metal clip; and a table top surface proximate to a top side of the table top frame.

2. The table of claim 1, wherein the table top frame is rectangular.

3. The table of claim 1, wherein each table leg includes a threaded hole configured to receive a threaded leg bolt that secures the table leg to the U-shaped metal clip.

4. The table of claim 3, wherein the first metal clip includes a threaded hole for receiving a first threaded clip bolt securing a first end of the U-shaped metal clip to the first metal clip and the second metal clip includes a threaded hole for receiving a second threaded clip bolt securing a second end of the U-shaped metal clip to the second metal clip.

5. The table of claim 1, wherein the table top frame includes a top lip, the first metal clip and the second metal clip each includes a top shoulder, and the table top surface is secured between the top lip of the table top frame and the top shoulders of the first metal clip and the second metal clip.

6. The table of claim 5, wherein the table top surface is made of glass.

7. The table of claim 6 further comprising a plastic clip proximate the first metal clip coupled between the rim of the table top frame and the table top surface.

8. The table of claim 5 further comprising a plastic clip coupled between the rim of the table top frame and the table top surface.

9. The table claim 1 further comprising a support ring coupled to legs to provide additional support.

10. A method of manufacturing a table comprising the steps:

forming a table top frame having a lower rim and a top lip around an interior of the table top frame;

placing a table top insert under the top lip of the table top frame; and attaching four corner assemblies at each corner of the table top frame, wherein each corner assembly includes the steps of:

slideably attaching a first metal clip to a first channel within a rim of a first side of the table frame proximate to a corner to support the table top insert;

slideably attaching a second metal clip to a second channel within a rim of a second side of the table frame proximate to the corner to support the table top insert;

attaching a U-shaped metal clip to the first metal clip using a first bolt and the second metal clip using a second bolt;

attaching a first plastic clip proximate the first metal clip between the rim of the first side of the table frame and the table top insert; and attaching a second plastic clip proximate the second metal clip between the rim of the second side of the table frame and the table top insert.

11. The method of claim 10 further comprising the step of bolting a set of legs to each corner assembly wherein each leg bisects the corner assembly and includes screw threads at one end of the each leg for bolting cash leg to each corner assembly.

12. The method of claim 11 further comprising the step of attaching a center ring to the set of legs to provide additional support for the set of legs.

13. The method of claim 10, wherein the step of attaching the set of legs includes screwing a bolt through an end of each leg and the U-shaped metal clip to secure the leg.

* * * * *